US005925148A

United States Patent [19]

Barfoed et al.

[11] Patent Number: 5,925,148

[45] Date of Patent: Jul. 20, 1999

[54] ENZYMATIC METHOD FOR OVERDYEING WARP DYED DENIM TEXTILES

[75] Inventors: Martin Barfoed, Raleigh, N.C.; Ole Kirk, Virum, Denmark

[73] Assignee: Novo Nordisk A/S, Bagsvaerd, Denmark

[21] Appl. No.: 08/901,548

[22] Filed: Jul. 28, 1997

Related U.S. Application Data

[63] Continuation-in-part of application No. 08/693,529, Aug. 2, 1996, abandoned

[60] Provisional application No. 60/028,848, Oct. 21, 1996.

[51] Int. Cl.[6] ..... D06P 1/32; D06P 3/60; D06P 5/02

[52] U.S. Cl. ..... 8/401; 8/441; 8/552; 8/553; 8/557; 8/649; 8/918; 8/930

[58] Field of Search ..... 8/401, 404, 406, 8/408, 416, 421, 424, 441, 553, 557, 552, 649, 918, 930; 435/263

[56] References Cited

U.S. PATENT DOCUMENTS

| | | | |
|---|---|---|---|
| 3,251,742 | 5/1966 | Soloway | 8/401 |
| 3,893,803 | 7/1975 | Kaiser | 8/401 |
| 3,912,447 | 10/1975 | Schmidt | 8/598 |
| 3,925,012 | 12/1975 | Ringel et al. | 8/602 |
| 3,934,971 | 1/1976 | Blanchard et al. | 8/485 |
| 3,957,424 | 5/1976 | Zeffren et al. | 8/401 |
| 3,993,436 | 11/1976 | Fujinuma | 8/424 |
| 4,283,196 | 8/1981 | Wenhoefer et al. | 8/531 |
| 4,961,925 | 10/1990 | Tsujino et al. | 8/406 |
| 5,104,646 | 4/1992 | Bolich, Jr. et al. | 8/405 |
| 5,460,966 | 10/1995 | Dixon | 435/263 |
| 5,538,517 | 7/1996 | Samain et al. | 8/423 |

FOREIGN PATENT DOCUMENTS

| | | |
|---|---|---|
| WO 94/00100 | 1/1994 | European Pat. Off. . |
| WO 95/33836 | 12/1995 | European Pat. Off. . |
| WO 97/23684 | 7/1997 | European Pat. Off. . |
| 2 694 018 | 1/1994 | France . |
| 36 36 387 | 4/1988 | Germany . |

OTHER PUBLICATIONS

English language of translation of Kurabo, JP 6–316,874, pp. 1–8, Nov 1994.

English language translation of JP 2–104,773, Nagase Co. Ltd., pp. 1–19, Apr. 1990.

Nagase Sangyo KK, Japanese Abstract of JP 02104773 (Apr. 17, 1990).

Kurabo Ind. Ltd., Japanese Abstract of JP 06316874 (Nov. 15, 1994).

Osaka Prefecture, Japanese Abstract of JP 08127976 (May 21, 1996).

*Primary Examiner*—Caroline D. Liott

*Attorney, Agent, or Firm*—Steve T. Zelson, Esq.; Cheryl Agris, Esq.

[57] ABSTRACT

The present invention relates to methods of overdyeing a warp dyed denim textile, comprising treating the textile in an aqueous dye liquor with a dye system which comprises an effective amount of (a) one or more mono-, di- or polycyclic aromatic or heteroaromatic compounds and (b) (i) a hydrogen peroxide source and at least one enzyme exhibiting peroxidase activity and/or (ii) at least one enzyme exhibiting oxidase activity on the one or more aromatic or heteroaromatic compounds.

22 Claims, No Drawings

ENZYMATIC METHOD FOR OVERDYEING WARP DYED DENIM TEXTILES

CROSS-REFERENCE TO RELATED APPLICATIONS

This application is a continuation-in-part of Ser. No. 08/693,529 filed Aug. 2, 1996, now abandoned, which claims priority under 35 U.S.C. 119 of provisional application Ser. No. 60/028,848 filed Oct. 21, 1996, the contents of which are fully incorporated herein by reference.

FIELD OF THE INVENTION

The present invention relates to methods of overdyeing a dyed fabric or article using (a) one or more mono-, di- or polycyclic aromatic or heteroaromatic compounds and (b) (i) a hydrogen peroxide source and at least one enzyme exhibiting peroxidase activity and/or (ii) at least one enzyme exhibiting oxidase activity on the one or more aromatic or heteroaromatic compounds.

BACKGROUND OF THE INVENTION

Dyed cellulosic textiles are commonly used in making a large variety of products, e.g., denim jeans. One class of denim are garments and articles which are characterized as overdyed denim. These products are produced by subjecting a warp dyed denim with undyed fill yarn to a further dyeing step. The further dyeing step imparts to the denim a particular color tint which is introduced by the dye, which is especially evident from the fill yarn. This further dyeing step acts to primarily dye the fill yarn of the desized denim but also imparts some degree of dyeing to the previously dyed warp yarn. Producing overdyed denim garments and articles requires that the desized denim is contacted in a dye bath with a selected dye under appropriate conditions. For such dyeing operations, direct dyes as defined in the Colour Index are generally used. The denim containing products are contacted with the direct dye in a bath under conditions which are dictated by the direct dye selected. These conditions are generally at a temperature in the range of 85°–95° C., for a period of about 0.5–2.5 hours in an aqueous bath which typically further includes an effective amount of a salt generally to provide a bath concentration of 5–40 g of salt per liter of bath. Typical dye baths have a pH in the range of 7–8.5.

U.S. Pat. No. 5,469,966 discloses a process for the treatment of denim textiles by contacting the denim textile with a cellulase in the presence of a dye to impart a stone-washed and overdyed effect on the denim textile.

It is an object of the present invention to provide an improved enzymatic method for overdyeing fabrics and articles.

SUMMARY OF THE INVENTION

The present invention relates to methods of overdyeing a dyed fabric or article, comprising treating the fabric or article with a dyeing system comprising an effective amount of (a) one or more mono-, di- or polycyclic aromatic or heteroaromatic compounds and (b) (i) a hydrogen peroxide source and at least one enzyme exhibiting peroxidase activity and/or (ii) at least one enzyme exhibiting oxidase activity on the one or more aromatic or heteroaromatic compounds.

The present invention also relates to aqueous dye liquors for imparting an overdyed appearance on a dyed fabric or article, comprising (a) one or more mono-, di- or polycyclic aromatic or heteroaromatic compounds and (b) (i) a hydrogen peroxide source and at least one enzyme exhibiting peroxidase activity and/or (ii) at least one enzyme exhibiting oxidase activity on the one or more aromatic or heteroaromatic compounds, in amounts effective to impart an overdyed appearance to the fabric or article.

The present invention also relates to fabric or article treatment composition, comprising (a) one or more mono-, di- or polycyclic aromatic or heteroaromatic compounds and (b) (i) a hydrogen peroxide source and at least one enzyme exhibiting peroxidase activity and/or (ii) at least one enzyme exhibiting oxidase activity on the one or more aromatic or heteroaromatic compounds, in amounts effective to impart an overdyed appearance to the fabric or article.

DETAILED DESCRIPTION OF THE INVENTION

According to the methods of the present invention, a dyed fabric or article is treated in an aqueous dye liquor which comprises effective amounts of (a) one or more mono-, di- or polycyclic aromatic or heteroaromatic compounds and (b) (i) a hydrogen peroxide source and at least one enzyme exhibiting peroxidase activity and/or (ii) at least one enzyme exhibiting oxidase activity on the one or more aromatic or heteroaromatic compounds.

Dyed Fabric or Article

The dyed fabric or article is preferably a textile, yarn, fiber, garment or film. The dyed fabric or article may be made of cotton, diacetate, flax, fur, hide, linen, lyocel, polyacrylic, polyamide, polyester, ramie, rayon, tencel, triacetate, viscose or wool. Preferably, the dyed fabric or article is a cellulosic or cellulose-containing fabric or article.

The dyed fabrics and articles are generally constructed of a warp yarn which is woven with a filing yarn. Generally, the warp yarn is dyed a color such as indigo, blue, black or other color while the filing yarn is generally an unbleached or white yarn. Dyed fabrics and articles where both the warp yarn and the filling yarn are dyed may also be used.

In a preferred embodiment, the fabric or article is a dyed fabric or article, e.g., denim. In this embodiment, the aromatic or heteroaromatic compound reacts with the dye already present on the fabric or article.

In another preferred embodiment, the fabric or article contain one or more aromatic, e.g., phenolic, compounds which enhance the binding of the mono-, di- or polycyclic aromatic or heteroaromatic compound to the fabric or article.

The mono-, di- or polycyclic aromatic or heteroaromatic compounds used in the methods of the present invention preferably are optionally substituted with one or more functional groups or substituents, wherein each functional group or substituent is selected from the group consisting of halogen; sulfo; sulfonato; sulfamino; sulfanyl; amino; amido; nitro; azo; imino; carboxy; cyano; formyl; hydroxy; halocarbonyl; carbamoyl; carbamidoyl; phosphonato; phosphonyl; $C_{1-18}$-alkyl; $C_{1-18}$-alkenyl; $C_{1-18}$-alkynyl; $C_{1-18}$-alkoxy; $C_{1-18}$-oxycarbonyl; $C_{1-18}$-oxoalkyl; $C_{1-18}$-alkyl sulfanyl; $C_{1-18}$-alkyl sulfonyl; $C_{1-18}$-alkyl imino or amino which is substituted with one, two or three $C_{1-18}$-alkyl groups; wherein each $C_{1-18}$-alkyl, $C_{1-18}$-alkenyl and $C_{1-18}$-alkynyl group may be mono-, di or poly-substituted by any of the proceeding functional groups or substituents. Examples of such mono-, di- or polycyclic aromatic or heteroaromatic compounds include, but are not limited to, acridine, anthracene, azulene, benzene, benzofurane, benzothiazole, benzothiazoline, carboline, carbazole, cinnoline, chromane, chromene, chrysene, fulvene, furan, imidazole, indazole, indene, indole, indoline, indolizine, isothiazole, isoquinoline, isoxazole, naphthalene, naphthylene, naphthylpyridine, oxazole, perylene, phenanthrene, phenazine, phtalizine, pteridine, purine, pyran, pyrazole, pyrene, pyridazine, pyridazone, pyridine, pyrimidine, pyrrole, quinazoline, quinoline, quinoxaline, sulfonyl, thiophene, and triazine, each of which are optionally substituted. Examples of such compounds include, but are not limited to, aromatic diamines, aminophenols, phenols and naphthols.

Examples of aromatic and heteroaromatic compounds for use in the present invention include, but are not limited to:

3,4-diethoxyaniline
2-methoxy-p-phenylenediamine,
1-amino-4-B-methoxyethylamino-benzene(N-B-methoxyethyl p-phenylenediamine),
1 -amino-4-bis-(B-hydroxyethyl)-aminobenzene (N,N-bis-(B-hydroxyethyl)-p-phenylenediamine),
2-methyl-1,3-diamino-benzene (2,6-diaminotoluene),
2,4-diaminotoluene,
2,6-diaminopyridine,
1-amino-4-sulfonato-benzene,
1-N-methylsulfonato-4-aminobenzene,
1-methyl-2-hydroxy-4-amino-benzene (3-amino o-cresol),
1-methyl-2-hydroxy-4-B-hydroxyethylamino-benzene (2-hydroxy-4-B-hydroxyethylamino-toluene),
1-hydroxy-4-methylamino-benzene (p-methylaminophenol),
1-methoxy-2,4-diamino-benzene (2,4-diaminoanisole),
1-ethoxy-2,3-diamino-benzene (2,4-diaminophenetole),
1-b-hydroxyethyloxy-2,4-diamino-benzene (2,4-diaminophenoxyethanol),
1,3-dihydroxy-2-methylbenzene (2-methyl resorcinol),
1,2,4-trihydroxybenzene,
1,2,4-trihydroxy-5-methylbenzene (2,4,5-trihydroxytoluene),
2,3,5-trihydroxytoluene,
4,8-disulfonato-1-naphthol,
3-sulfonato-6-amino-1-naphthol (J acid),
6,8-disulfonato-2-naphthol,
1,4-Phenylenediamine
2,5-Diaminotoluene
2-Chloro-1,4-phenylenediamine
2-Aminophenol
3-Aminophenol
4-Aminophenol
1,3-Phenylenediamine
1-Naphthol
2-Naphthol
4-Chlororesorcinol
1,2,3-benzenetriol (Pyrogallol)
1,3-Benzenediol (Resorcinol)
1,2-Benzenediol (Pyrocatechol)
2-Hydroxy-cinnamic acid
3-Hydroxy-cinnamic acid
4-Hydroxy-cinnamic acid
2,3-diaminobenzoic acid
2,4-diaminobenzoic acid
3,4-diaminobenzoic acid
3,5-diaminobenzoic acid
Methyl 2,3-diaminobenzoate
Ethyl 2,3-diaminobenzoate
Isopropyl 2,3-diaminobenzoate
Methyl 2,4-diaminobenzoate
Ethyl 2,4-diaminobenzoate
Isopropyl 2,4-diaminobenzoate
Methyl 3,4-diaminobenzoate
Ethyl 3,4-diaminobenzoate
Isopropyl 3,4-diaminobenzoate
Methyl 3,5-diaminobenzoate
Ethyl 3,5-diaminobenzoate
Isopropyl 3,5-diaminobenzoate
N,N-dimethyl-3,4-diaminobenzoic acid amide
N,N-diethyl-3,4-diaminobenzoic acid amide
N,N-dipropyl-3,4-diaminobenzoic acid amide
N,N-dibutyl-3,4-diaminobenzoic acid amide
4-Chloro-1-naphthol
N-Phenyl-p-phenylenediamine
3,4-Dihydroxybenzaldehyde
Pyrrole
Pyrrole-2-isoimidazole
1,2,3-Triazole
Benzotriazole
Benzimidazole
Imidazole
Indole
1-Amino-8-hydroxynaphthalene-4-sulfonic acid (S acid)
4,5-Dihydroxynapthalene-2,7-disulfonic acid (Chromotropic acid)
Anthranilic acid
4-Aminobenzoic acid (PABA)
2-Amino-8-naphthol-6-sulfonic acid (Gamma acid)
5-Amino-1-naphthol-3-sulfonic acid (M acid)
2-Naphthol-3,6-disulfonic acid (R acid)
1Amino-8-naphthol-2,4-disulfonic acid (Chicago acid)
1-Naphthol-4-sulfonic acid (Nevile and Winther's acid)
Peri acid
N-Benzoyl J acid
N-Phenyl J acid
1,7-Cleves acid
1,6-Cleves acid
Bon acid
Naphthol AS
Disperse Black 9
Naphthol AS OL
Naphthol AS PH
Naphthol AS KB
Naphthol AS BS
Naphthol AS D
Naphthol AS BI
Mordant Black 3 CI 14640 (Eriochrome Blue Black B)
4-Amino-5-hydroxy-2,6-Naphthalene Disulphonic acid (H acid)
Fat Brown RR, Solvent Brown 1 (CI 11285)
Hydroquinone
Mandelic Acid
Melamine
o-Nitrobenzaldehyde
1,5-Dihydroxynaphthalene
2,6-Dihydroxynaphthalene
2,3-Dihydroxynaphthalene
Benzylimidazole
2,3-Diaminonaphthalene
1,5-Diaminonaphthalene
1,8-Diaminonaphthalene
Salicylic acid
3-aminosalicylic acid
4-aminosalicylic acid
5-aminosalicylic acid
Methyl-3-aminosalicylate
Methyl-4-aminosalicylate
Methyl-5-aminosalicylate Ethyl-3-aminosalicylate
Ethyl-4-aminosalicylate
Ethyl-5-aminosalicylate
Propyl-3-aminosalicylate
Propyl-4-aminosalicylate
Propyl-5-aminosalicylate
Salicylic amide
4-Aminothiophenol
4-Hydroxythiophenol
Aniline
4,4'-Diaminodiphenylamine sulfate
4-Phenylazoaniline
4-Nitroaniline
5 N,N-Dimethyl-1,4-phenylenediamine
N,N-Diethyl-1,4-phenylenediamine
Disperse Orange 3
Disperse Yellow 9
Disperse Blue 1
N-Phenyl-1,2-phenylenediamine
6-Amino-2-naphthol
3-Amino-2-naphthol
5-Amino-1-naphthol
1,2-Phenylenediamine
2-Aminopyrimidine
4-Aminoquinaldine
2-Nitroaniline
3-Nitroaniline
2-Chloroaniline
3-Chloroaniline
4-Chloroaniline
4-(phenylazo)resorcinol (Sudan Orange G, CI 11920)
Sudan Red B, CI 26110
Sudan Red 7B, CI 26050
4'-Aminoacetanilide
Alizarin
1-Anthramine (1-Aminoanthracene)
1 -Aminoanthraquinone
Anthraquinone
2,6-Dihydroxyanthraquinone (Anthraflavic Acid)
1,5-Dihydroxyanthraquinone (Anthrarufin)
3-Amidopyridine (Nicotinamide)
Pyridine-3-carboxylic acid (Nicotinic Acid)
Mordant Yellow 1, Alizarin Yellow GG, CI 14025
Coomassie Grey, Acid Black 48, CI 65005
Palantine Fast Black WAN, Acid Black 52, CI 15711
Palantine Chrome Black 6BN, CI 15705, Eriochrome Blue Black R
Mordant Black 11, Eriochrome Black T
Naphthol Blue Black, Acid Black 1, CI 20470
1,4-Dihydroxyanthraquinone (Quinizarin)
4-Hydroxycoumarin
Umbelliferone, 7-Hydroxycoumarin
Esculetin, 6,7-Dihydroxycoumarin
Coumarin
Chromotrope 2B, Acid Red 176, CI 16575
Chromotrope 2R, Acid Red 29, CI 16570
Chromotrope FB, Acid Red 14, CI 14720
2,6-Dihydroxyisonicotinic acid, Citrazinic acid
2,5-Dichloroaniline
2-Amino-4-chlorotoluene
2-Nitro-4-chloroaniline
2-Methoxy-4-nitroaniline and
p-Bromophenol.

Enzyme

The second component contained in the dyeing system used in the methods of the present invention is (a) a hydrogen peroxide source and at least one enzyme exhibiting peroxidase activity and/or (b) at least one enzyme exhibiting oxidase activity on the compound. Assays for determining the activity of these enzymes are well known to persons of ordinary skill in the art.

Enzymes exhibiting peroxidase activity include, but are not limited to, peroxidase (EC 1.11.1.7) and haloperoxidase, e.g., chloro-(EC 1.11.1.10), bromo-(EC 1.11.1) and iodoperoxidase (EC 1.11.1.8).

Enzymes exhibiting oxidase activity include, but are not limited to, bilirubin oxidase (EC 1.3.3.5), catechol oxidase (EC 1.10.3.1), laccase (EC 1.10.3.2), o-aminophenol oxidase (EC 1.10.3.4), and polyphenol oxidase (EC 1.10.3.2). Preferably, the enzyme is a laccase obtained from a genus selected from the group consisting of Aspergillus, Botrytis, Collybia, Fomes, Lentinus, Myceliophthora, Neurospora, Pleurotus, Podospora, Polyporus, Rhizoctonia, Scytalidium, and Trametes. In a more preferred embodiment, the laccase is obtained from a species selected from the group consisting of *Coprinus cinereus, Humicola brevis* var. *thermoidea, Humicola brevispora, Humicola grisea* var. *thermoidea, Humicola insolens,* and *Humicola lanuginosa* (also known as *Thermomyces lanuginosus*), *Myceliophthora thermophila, Myceliophthora vellerea, Polyporus pinsitus, Rhizoctonia solani, Scytalidium indonesiacum, Scytalidium thermophila,* and *Torula thermophila.* The laccase may be obtained from other species of Scytalidium, such as *Scytalidium acidophilum, Scytalidium album, Scytalidium aurantiacum, Scytalidium circinatum, Scytalidium flaveobrunneum, Scytalidium hyalinum, Scytalidium lignicola,* and *Scytalidium uredinicolum.* The laccase may be obtained from other species of Polyporus, such as *Polyporus alveolaris, Polyporus arcularius, Polyporus australiensis, Polyporus badius, Polyporus biformis, Polyporus brumalis, Polyporus ciliatus, Polyporus colensoi, Polyporus eucalyptorum, Polyporus meridionalis, Polyporus palustris, Polyporus rhizophilus, Polyporus rugulosus, Polyporus squamosus, Polyporus tuberaster, Polyporus tumulosus, Polyporus varius,* and *Polyporus zonatus.* The laccase may also be a modified laccase by at least one amino acid residue in a Type I (T1) copper site, wherein the modified oxidase possesses an altered pH and/or specific activity relative to the wild-type oxidase. For example, the modified laccase could be modified in segment (a) of the T1 copper site.

Peroxidases which may be employed in the methods of the present invention may be isolated from and are producible by plants (e.g., horseradish peroxidase) or microorganisms such as fungi or bacteria. Some preferred fungi include strains belonging to the subdivision Deuteromycotina, class Hyphomycetes, e.g., Arthromyces, Caldariomyces, Cladosporium, Dreschlera, Embellisia, Fusarium, Humicola, Myrothecium, Tricoderma, Ulocladium, or Verticillum, in particular, *Arthromyces ramosus* (FERM P-7754), *Caldariomyces fumago, Dreschlera halodes, Embellisia alli, Fusarium oxysporum* (DSM 2672), *Humicola insolens, Myrothecium verrucana* (IFO 6113), *Trichoderma resii, Ulocladium chartarum, Verticillum alboatrum,* and *Verticillum dahlie.*

Other preferred fungi include strains belonging to the subdivision Basidiomycotina, class Basidiomycetes, e.g., Coprinus, Coriolus, Phanerochaete, or Trametes, in particular *Coprinus cinereus* f. *microsporus* (IFO 8371), *Coprinus macrorhizus, Coriolus versicolor* (e.g., PR4 28-A) or *Phanerochaete chrysosporium* (e.g., NA-12).

Further preferred fungi include strains belonging to the subdivision Zygomycotina, class Mycoraceae, e.g., Mucor or Rhizopus, in particular *Mucor hiemalis.*

Some preferred bacteria include strains of the order Actinomycetales, e.g., *Streptomyces spheroides* (ATCC 23965), *Streptomyces thermoviolaceus* (IFO 12382) or *Streptoverticillum verticillium* ssp. *verticillium.* Other preferred bacteria include *Bacillus pumillus* (ATCC 12905), *Bacillus stearothermophilus, Pseudomonasfluorescens* (NRRL B-11), *Pseudomonas purrocinia* (ATCC 15958), *Rhodobacter sphaeroides, Rhodomonas palustri,* and *Streptococcus lactis.*

Other potential sources of peroxidases are listed in B. C. Saunders et al., op. cit. pp. 41–43.

Methods of producing enzymes to be used according to the invention are described in the art, e.g., *FEBS Letters* 1625, 173(1), *Applied and Environmental Microbiology,* February 1985, pp. 273–278, *Applied Microbiol. Biotechnol.* 26, 1987, pp. 158–163, *Biotechnology Letters* 9(5), 1987, pp. 357–360, *Nature* 326, Apr. 2, 1987, *FEBS Letters* 4270, 209(2), p. 321, EP 179 486, EP 200 565, GB 2 167 421, EP 171 074, and *Agric. Biol. Chem.* 50(1), 1986, p. 247.

Particularly preferred enzymes are those which are active at a pH in the range of about 2.5 to about 12.0, preferably in the range of about 4 to about 10, most preferably in the range of about 4.0 to about 7.0 and in the range of about 7.0 to about 10.0. Such enzymes may be isolated by screening for the relevant enzyme production by alkalophilic microorganisms, e.g., using the ABTS assay described in R. E. Childs and W. G. Bardsley, *Biochem. J.* 145, 1975, pp. 93–103.

Other preferred enzymes are those which exhibit a good thermostability as well as a good stability towards commonly used dyeing additives such as non-ionic, cationic, or anionic surfactants, chelating agents, salts, polymers, etc.

The enzymes may also be produced by a method comprising cultivating a host cell transformed with a recombinant DNA vector which carries a DNA sequence encoding said enzyme as well as DNA sequences encoding functions permitting the expression of the DNA sequence encoding the enzyme, in a culture medium under conditions permitting the expression of the enzyme and recovering the enzyme from the culture.

A DNA fragment encoding the enzyme may, for instance, be isolated by establishing a cDNA or genomic library of a microorganism producing the enzyme of interest, such as one of the organisms mentioned above, and screening for positive clones by conventional procedures such as by hybridization to oligonucleotide probes synthesized on the basis of the full or partial amino acid sequence of the enzyme, or by selecting for clones expressing the appropriate enzyme activity, or by selecting for clones producing a protein which is reactive with an antibody against the native enzyme.

Once selected, the DNA sequence may be inserted into a suitable replicable expression vector comprising appropriate promotor, operator and terminator sequences permitting the enzyme to be expressed in a particular host organism, as well as an origin of replication enabling the vector to replicate in the host organism in question.

The resulting expression vector may then be transformed into a suitable host cell, such as a fungal cell, preferred examples of which are a species of Aspergillus, most preferably *Aspergillus niger* or *Aspergillus oryzae.* Fungal cells may be transformed by a process involving protoplast formation and transformation of the protoplasts followed by regeneration of the cell wall in a manner known per se. The use of Aspergillus as a host microorganism is described in EP 238,023 (of Novo Industri A/S), the contents of which are hereby incorporated by reference.

Alternatively, the host organisms may be a bacterium, in particular strains of Bacillus, *E. coli,* or Streptomyces. The transformation of bacterial cells may be performed according to conventional methods, e.g., as described in T. Maniatis et al., *Molecular Cloning: A Laboratory Manual,* Cold Spring Harbor, 1982.

The screening of appropriate DNA sequences and construction of vectors may also be carried out by standard procedures, cf. T. Maniatis et al., op. cit.

The medium used to cultivate the transformed host cells may be any conventional medium suitable for growing the host cells in question. The expressed enzyme may conveniently be secreted into the culture medium and may be recovered therefrom by well-known procedures including separating the cells from the medium by centrifugation or filtration, precipitating proteinaceous components of the medium by means of a salt such as ammonium sulphate, followed by chromatographic procedures such as ion exchange chromatography, affinity chromatography, or the like.

When the enzyme employed in the methods of the present invention is a peroxidase, the dye liquor must contain a hydrogen peroxide source, e.g., hydrogen peroxide itself. The hydrogen peroxide source may be added at the beginning or during the process, e.g., in an amount in the range of 0.001–5 mM, preferably in the range 0.01–1 mM. One source of hydrogen peroxide includes precursors of hydrogen peroxide, e.g., a perborate or a percarbonate. Another source of hydrogen peroxide includes enzymes which are able to convert molecular oxygen and an organic or inorganic substrate into hydrogen peroxide and the oxidized substrate, respectively. These enzymes produce only low levels of hydrogen peroxide, but they may be employed to great advantage in the process of the invention as the presence of peroxidase ensures an efficient utilization of the hydrogen peroxide produced. Examples of enzymes which are capable of producing hydrogen peroxide include, but are not limited to, glucose oxidase, urate oxidase, galactose oxidase, alcohol oxidase, amine oxidase, amino acid oxidase and cholesterol oxidase.

The relative proportions of the constituents used in the process vary over a wide range and depend on the ultimate textile treatment to be effectuated. Variables to be considered include process conditions such as time, temperature and pH. These relative proportions may be determined by routine experimentation. In a preferred embodiment, the mono-, di- or polycyclic aromatic or heteroaromatic compound is present at a concentration in the range of 0.0001–50 mg/ml, more preferably in the range of 0.001–5 mg/ml and the enzyme is present in an amount in the range of 0.00002–1 mg/ml, more preferably in the range of 0.0002–0.1 mg/ml.

The dye liquor used in the methods of the present invention preferably has a water/textile ratio in the range of about 5:1 to about 200:1, more preferably in the range of about 5:1 to about 20:1.

The dye liquor may further comprise conventional constituents, e.g., wetting agents, suspension agents, dispersants, surfactants, leveling agents, and buffering agents. For example, the dye liquor may further comprise a mono- or divalent ion which includes, but is not limited to, sodium, potassium, calcium and magnesium ions (0–3 M, preferably 25 mM–1 M), a polymer which includes, but is not limited to, polyvinylpyrrolidone, polyvinylalcohol, polyaspartate, polyvinylamide, polyethelene oxide (0–50 g/l, preferably 1–500 mg/l) and a surfactant (10 mg–5 g/l). Examples of such surfactants are anionic surfactants such as carboxylates, for example, a metal carboxylate of a long chain fatty acid; N-acylsarcosinates; mono or di-esters of phosphoric acid with fatty alcohol ethoxylates or salts of such esters; fatty alcohol sulphates such as sodium dodecyl sulphate, sodium octadecyl sulphate or sodium cetyl sulphate; ethoxylated fatty alcohol sulphates; ethoxylated alkylphenol sulphates; lignin sulphonates; petroleum sulphonates; alkyl aryl sulphonates such as alkyl-benzene sulphonates or lower alkylnaphthalene sulphonates, e.g., butyl-naphthalene sulphonate; salts or sulphonated naphthalene-formaldehyde condensates; salts of sulphonated phenol-formaldehyde condensates; or more complex sulphonates such as amide sulphonates, e.g., the sulphonated condensation product of oleic acid and N-methyl taurine or the dialkyl sulphosuccinates, e.g., the sodium sulphonate or dioctyl succinate. Further examples of such surfactants are non-ionic surfactants such as condensation products of fatty acid esters, fatty alcohols, fatty acid amides or fatty-alkyl- or alkenyl-substituted phenols with ethylene oxide, block copolymers of ethylene oxide and propylene oxide, acetylenic glycols such as 2,4,7,9-tetraethyl-5-decyn-4,7-diol, or ethoxylated acetylenic glycols. Further examples of such surfactants are cationic surfactants such as aliphatic mono-, di-, or polyamines such as acetates, naphthenates or oleates; oxygen-containing amines such as an amine oxide of polyoxyethylene alkylamine; amide-linked amines prepared by the condensation of a carboxylic acid with a di- or polyamine; or quaternary ammonium salts.

In the methods of the present invention, the treatment may be carried out at a temperature in the range of about 5 to about 120° C., preferably in the range of about 5 to about 80° C., and more preferably in the range of about 15 to about 70° C., and a pH in the range of about 2.5 to about 12, preferably between about 4 and about 10, more preferably in the range of about 4.0 to about 7.0 or in the range of about 7.0 to about 10.0. Preferably, a temperature and pH near the temperature and pH optima of the enzyme, respectively, are used.

The dyed fabric or article may be treated with the compound simultaneously with or prior to the treatment with (b) (i) a hydrogen peroxide source and at least one enzyme exhibiting peroxidase activity and/or (ii) at least one enzyme exhibiting oxidase activity on the compound. In a preferred embodiment, the dyed fabric or article is first presoaked with the compound before adding the enzyme.

Following treatment in the dye liquor, the fabric or article may be rinsed with hot or cold water. One or more of the rinses may also include a scavenger for dye components which may have been freed or remain as residual products from the single bath process. The fabric or article also may be subjected to further conventional treatments steps, e.g., finishing such as by treatment with softening, finishing and lubricating agents.

The invention is further illustrated by the following non-limiting example.

EXAMPLES

Example 1

DETERMINATION OF LACCASE ACTIVITY

Laccase activity is determined from the oxidation of syringaldazin under aerobic conditions. The violet color produced is measured by spectrophotometry at 530 nm. The analytical conditions are 19 $\mu$M syringaldazin, 23.2 mM acetate buffer, pH 5.5, 30° C., and 1 minute reaction time. One laccase unit (LACU) is the amount of laccase that catalyzes the conversion of 1 $\mu$mole syringaldazin per minute at these conditions.

OVERDYEING OF FABRICS

One liter of buffer is prepared by dissolving 30 g sodium acetate per liter of deionized water. One or two compounds selected from the group consisting of p-phenylenediamine ("A"), 2-chloro-1,4-phenylene-diamine ("B"), 4-aminophenol ("C"), 4-aminophenol ("D") and 1-naphthol ("E") in amounts of 3.75 g per precursor (or 7.5 g in experiments where only one compound is used) are dissolved in the buffer. The pH of the buffer is adjusted to pH 5.0.

Three pieces of denim legs which are stone-washed using a cellulase (DENIMAX ULTRA L), are added to a washing machine. One liter of precursor-containing buffer and thirteen liters of water are added to the washing machine to give a final sodium acetate concentration of 2.14 g/l.

The denim legs are presoaked with the compound(s) for 10 minutes at 40° C.

Ten ml of a *Myceliophthora thermophila* laccase (deposited with the Centraal Bureau voor Schimmelcultures and given accession number CBS 117.65) having an activity of 690 LACU/ml is added to the washing machine to give a final activity of about 0.49 LACU/ml. The denim legs are overdyed for 42.5 minutes at 40° C. followed by three drain/rinse cycles and an extraction.

One leg from each dyeing experiment is collected and washed for three cycles in a multicycle washing machine.

The legs are dried and the Hunter Lab values are measured using a reflection spectrophotometer.

The results of the experiments are provided in the following tables:

TABLE 1

Appearance Based On Visual Inspection.

| Precursor(s) | Before wash | After wash |
|---|---|---|
| A | Deep purple/brown on blue and white yarns | Deep purple/brown on blue yarns lighter on white |
| A/D | Deep green on blue and white yarns | Deep green on blue yarns lighter on white |
| A/E | Purple on white yarns lighter on blue | Purple on blue yarns lighter on white |
| B | Deep orange/brown on blue and white yarns | Brown on blue yarns lighter on white |
| C/E | Purple/pink on white yarns lighter on blue | Pink/blue. Pink on white yarns blue on blue |

TABLE 2

ColorEye Measurement on Denim

| Leg Treatment | L | a | b |
|---|---|---|---|
| Untreated | 32.76 | −2.15 | −15.83 |
| A | 14.86 | 1.97 | −1.03 |
| Washed A | 17.60 | 2.44 | 0.70 |
| A/D | 13.92 | −0.25 | 2.23 |
| Washed A/D | 17.45 | −0.10 | 3.07 |
| A/E | 16.43 | 2.88 | −2.39 |
| Washed A/E | 20.18 | 2.76 | −1.25 |
| B | 17.33 | 3.34 | 2.24 |
| Washed B | 21.81 | 2.54 | 1.10 |
| C/E | 23.39 | 3.63 | −3.61 |
| Washed C/E | 26.98 | 1.20 | −4.83 |

The results show that all combinations of dye and laccase are able to overdye the denim. In particular, the use of compound A formed deep and uniform shades.

The results also show a good wash fastness, i.e., the overdyeing appearance remained on the legs after washing. Denim overdyed using compound E results in the least wash fastness, especially, the combination of C/E which caused the indigo blue color to return after wash, leaving only a pinkish color on the white yarns. The other combinations had increased contrast after wash as the dye mostly washed off the white yarns resulting in maintaining the contrast between the dyed and undyed yarns.

What is claimed is:

1. A method of overdyeing a warp dyed denim textile, comprising treating the warp dyed denim textile in an aqueous dye liquor with a dyeing system which comprises (a) one or more compounds selected from the group consisting of a monoaromatic, diaromatic, polycyclic aromatic and heteroaromatic compounds which are optionally substituted with one or more functional groups or substituents, wherein each functional group or substituent is selected from the group consisting of halogen; sulfo; sulfonato; sulfamino; sulfanyl; amino; amido; nitro; azo; imino; carboxy; cyano; formyl; hydroxy; halocarbonyl; carbamoyl; carbamidoyl; phosphonato; phosphonyl; $C_{1-18}$-alkyl; $C_{1-18}$-alkenyl; $C_{1-18}$-alkynyl; $C_{1-18}$-alkoxy; $C_{1-18}$-oxycarbonyl; $C_{1-18}$-oxoalkyl; $C_{1-18}$-alkyl sulfanyl; $C_{1-18}$-alkyl sulfonyl; $C_{1-18}$-alkyl imino and amino which is substituted with one, two or three $C_{1-18}$-alkyl groups; wherein each $C_{1-18}$-alkyl, $C_{1-18}$-alkenyl and $C_{1-18}$-alkynyl group may be mono-, di or poly-substituted by any of the proceeding functional groups or substituents, and (b) (i) a hydrogen peroxide source and at least one enzyme exhibiting peroxidase activity on the one or more aromatic or heteroaromatic compounds of (a) and/or (ii) at least one enzyme exhibiting oxidase activity on the one or more aromatic or heteroaromatic compounds of (a), in which (a) and (b) are present in amounts effective to impart an overdyed appearance to the warp dyed denim textile.

2. The method according to claim 1, wherein the warp dyed denim textile is presoaked with the one or more compounds of (a) prior to the treatment with the enzymes of (b).

3. The method according to claim 1, wherein the compound is a naphthol.

4. The method according to claim 1, wherein the compound is an aromatic diamine.

5. The method according to claim 1, wherein the compound is an aminophenol.

6. The method according to claim 1, wherein the compound is a phenol.

7. The method according to claim 1, wherein the dyeing system comprises at least one enzyme exhibiting oxidase activity on the compound.

8. The method according to claim 7, wherein the enzyme exhibiting oxidase activity is a bilirubin oxidase.

9. The method according to claim 7, wherein the enzyme exhibiting oxidase activity is a catechol oxidase.

10. The method according to claim 7, wherein the enzyme exhibiting oxidase activity is a laccase.

11. The method according to claim 7, wherein the enzyme exhibiting oxidase activity is an o-aminophenol oxidase.

12. The method according to claim 7, wherein the enzyme exhibiting oxidase activity is a polyphenol oxidase.

13. The method according to claim 1, wherein the dyeing system comprises a hydrogen peroxide source and at least one enzyme exhibiting peroxidase activity on the compounds of (a).

14. The method according to claim 13, wherein the enzyme exhibiting peroxidase activity is a peroxidase.

15. The method according to claim 13, wherein the enzyme exhibiting peroxidase activity is a haloperoxidase.

16. The method according to claim 1, wherein the denim textile is a cellulosic or cellulose-containing denim textile.

17. The method according to claim 1, wherein the denim textile is treated with the dyeing system at a temperature in the range of about 5 to about 120° C.

18. The method according to claim 1, wherein the denim textile is treated with the dyeing system at a pH in the range of about 4 to about 10.

19. The method according to claim 1, wherein the dyeing liquor further comprises a mono or divalent ion selected from the group consisting of sodium, potassium, calcium and magnesium ions.

20. The method according to claim 1, wherein the dyeing liquor further comprises a polymer selected from the group consisting of polyvinylpyrrolidone, polyvinylalcohol, polyaspartate, polyvinylamide and polyethylene oxide.

21. The method according to claim 1, wherein the dye liquor further comprises an anionic, nonionic or cationic surfactant.

22. The method according to claim 1, wherein the one or more compounds of (a) reacts with the dye already present on the warp dyed denim textile.

* * * * *